United States Patent [19]

Ogawa

[11] 4,132,028

[45] Jan. 2, 1979

[54] RECONFIGURABLE TOY WITH OPTICAL ELEMENTS

[75] Inventor: Iwakichi Ogawa, Kashiwa, Japan

[73] Assignee: Takara Co., Ltd., Tokyo, Japan

[21] Appl. No.: 798,838

[22] Filed: May 20, 1977

[51] Int. Cl.[2] ..... A63H 33/06

[52] U.S. Cl. ..... 46/17; 46/202; 46/223

[58] Field of Search ..... 46/17, 16, 23, 202, 46/204, 221, 112, 116, 1 R, 201, 251, 39, 223; 273/156

[56] References Cited

U.S. PATENT DOCUMENTS

| | | | |
|---|---|---|---|
| 2,496,603 | 2/1950 | Schwanengel | 46/204 |
| 2,791,867 | 5/1957 | Dasher | 46/17 |
| 3,441,270 | 4/1969 | Nielsen | 46/1 R X |
| 3,764,057 | 9/1956 | Oller, Jr. | 46/49 X |

*Primary Examiner*—Russell R. Kinsey
*Assistant Examiner*—Mickey Yu
*Attorney, Agent, or Firm*—Harold L. Jackson; Stanley R. Jones; Joseph W. Price

[57] ABSTRACT

A toy including a number of press-fitting parts configurable as a rocket plane is provided. A number of the parts include optical elements which may function as a kaleidoscope, or, in a second configuration, as a periscope. Some of the parts may be assembled to form a blow-gun for discharging a toy projectile at a toy target.

11 Claims, 5 Drawing Figures

11
13
15
17
21
27
29
31
33
35
37
41
43
44
45
47
49
50
51
52
53
55
57
59
61
63
65
69
71

RECONFIGURABLE TOY WITH OPTICAL ELEMENTS

BACKGROUND OF THE INVENTION

1. Field of the Invention

The subject invention relates to toys and more particularly to a toy which may be reassembled to form a variety of configurations providing a number of toy functions.

2. Description of the Prior Art

In the prior art, the toy industry has provided unitary rocket ship toys. Toys of the building block variety have also been provided wherein subcomponents of standard configurations are combined to form various structures. An example of such a toy is the well-known erector set.

To date, the known prior art has not provided a rocket plane toy with parts easily disassembleable and formable into other interesting toy configurations. Moreover, the inclusion of optical elements within the subcomponents of a rocketplane assembly has not been disclosed in the known prior art.

SUMMARY OF THE INVENTION

It is an object of the invention to provide a toy having a number of subcomponents of varying geometric shapes which may be combined to form a rocketship or a number of other interestingly futuristically shaped toys.

It is another object of the invention to incorporate optical elements into the subcomponents such that interesting toys involving optical effects result.

These and other objects and advantages of the invention are accomplished by providing a base or body member with a number of apertures in which a number of other elements may be fitted to form a toy which may initially appear as a rocketplane. The parts may then be reattached at other locations on the body member or with one another in various orientations to form other toy configurations.

As an additional feature, reflective surfaces may be provided at various locations within the elements or the body member to provide optical effects in various configurations of the elements.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DETAILED DESCRIPTION OF THE PREFERRED EMBODIMENT

The following description is provided to enable any person skilled in the toy industry to make and use the invention, and it sets forth the best mode contemplated by the inventor of carrying out this invention. Various modifications, however, will remain readily apparent to those skilled in the above art, since the generic principals of the present invention are applied herein specifically to provide a relatively economical and easily manufactured mobile reconfigureable rocket toy.

Figure 1:
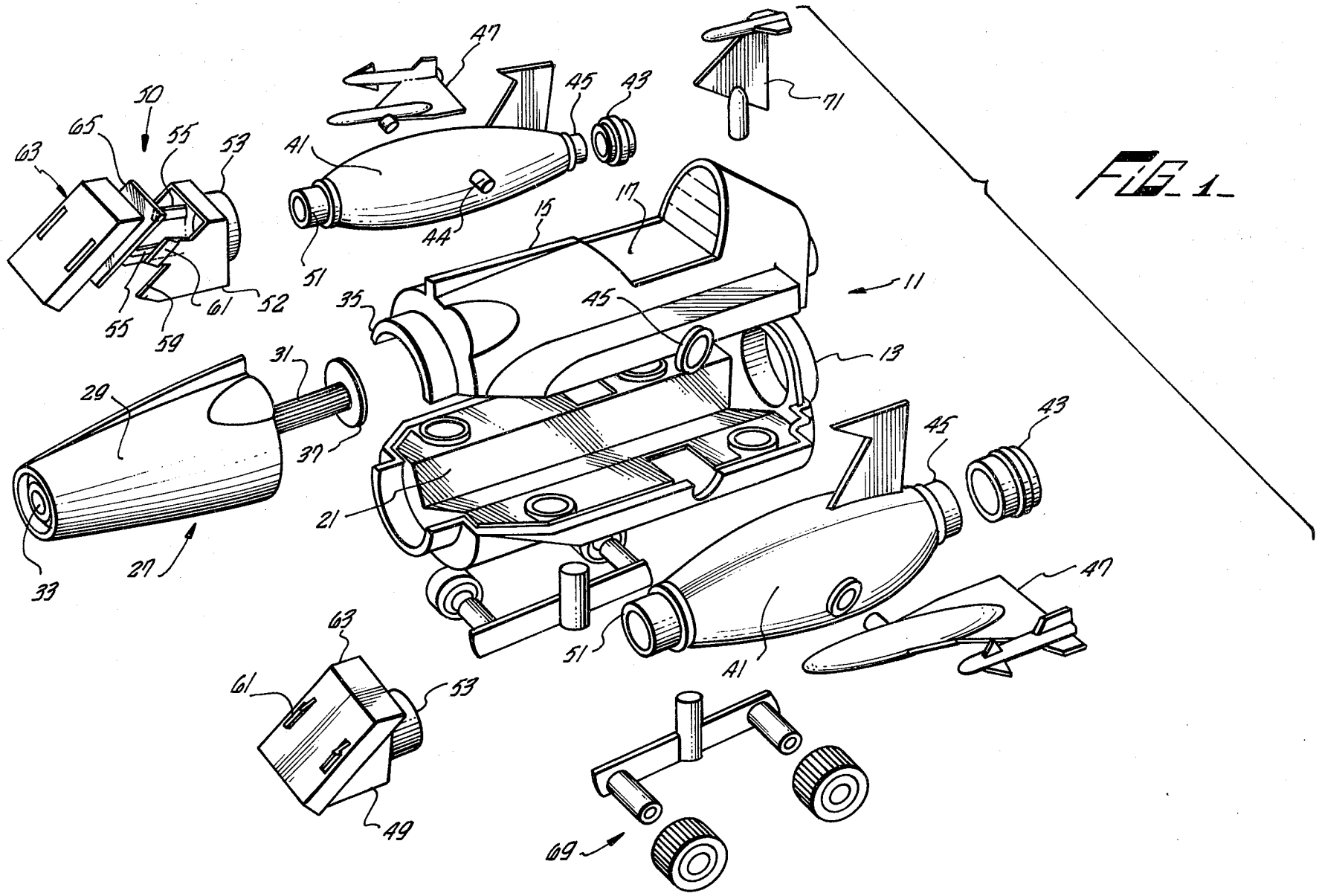
FIG. 1 is an exploded view of the preferred embodiment of the invention in the rocket plane configuration.

As illustrated in FIG. 1, the body 11 of the toy is comprised of a lower section 13 and an upper section 15. The upper section 15 defines a seat compartment 17 in which a miniature doll figure may be placed. The lower section 13 contains edges on which a V-shaped plastic section 21 with a mirror coating may be placed. When the body sections 13, 11 are joined together, for example by screws, pins, preferably molded as part of the body upper section 15, retain the mirror in place in the lower body section 13.

The rocket nose assembly 27 includes a nose piece 29 and a rotatable antenna member 31, which, when in position, extends through the front opening 33 of the nose member 29. The body member 11 has a mounting rim 35 on which the nose assembly 27 tightly press-fits. The antenna member 31 has a disc 37 thereon, which projects slightly into the interior of the body 11 when the body 11 and nose assembly 27 are press-fitted together.

Figure 2:
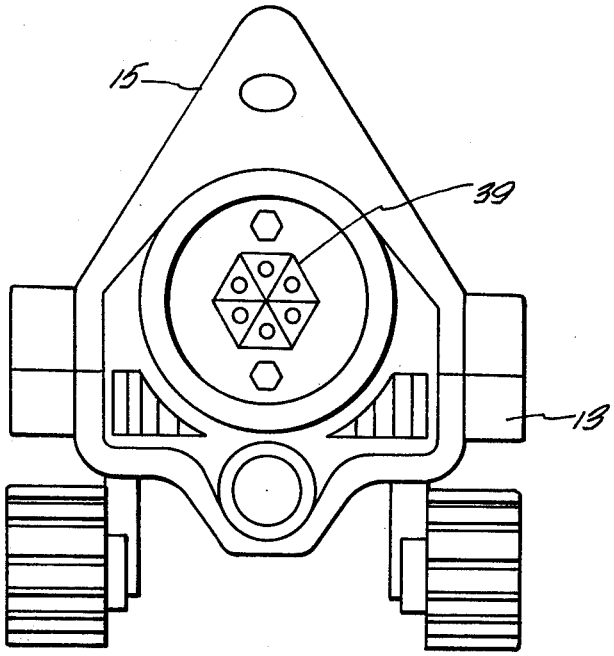
FIG. 2 illustrates the kaleidascope at the exhaust location of the rocket body.

When the nose assembly 27 and body 11 are joined together and an ornamental decal or sticker is applied to the face of the disc 37, a kaleidoscope results. The kaleidoscope effect is observed at the exhaust opening 39 (FIG. 2) of the body member 11. The rotatable disc 37, the mirror element 21 and the body 11 essentially combine to form the kaleidoscope. When the antenna extension 31 is manually rotated, the disc 37 turns and the optical effect produced by the mirror 21 is that of a kaleidoscope when observed at the exhaust opening 39.

To give the toy a rocket-like appearance, engine pods 41 are provided. These pods 41 attach by means of press-fit plugs 44 into press-fit openings 45 in the respective sides of the rocket body 11. Each of these pods 41 may mount a press-fit exhaust muffler 43 on a rim 45. Simulated rocket-bearing wing tips 47 may be attached by press-fit means to the pods 41 to create a winged vehicle. Finally, a wedged shaped hood 49, 50 may be press-fit mounted onto a press-fit rim 51 on each of the engine pods 41.

The engine hood 50 is broken apart in FIG. 1 to show its internal structure, which enables the toy to be configured as a periscope. The hood 50 breaks apart into a wedge shaped portion 52 having a rim 53 mounted at the rear thereof for plugging onto the press-fit rim 51 of an engine pod 41. Suitable interior ridges 55 are formed in the interior of the member 51 and are cut off just short of its slanted edge 59. The slanted edge 59 also bears two lipped projections 61 which may be inserted into corresponding openings in a cover element 63. The interior ridges 55 define a slanted planar surface and thus may support a planar mirror element 65 at an angle determined by their relative length. To assemble the engine hood 50, the mirror 65 is simply placed on the edges 55 and the cover 63 is placed onto the projections 61. The element 63 may be attached by snap-fitting onto the lipped projections 61.

To complete the rocket plane assembly, suitable landing gear carriages 69 may be press-fit by means of press-fit plugs into the underside of the lower body member 13. Additionally, a vertical stabilizer 71 may be press-fit into an aperture 73 located just behind the pilot compartment 17.

Figure 3:
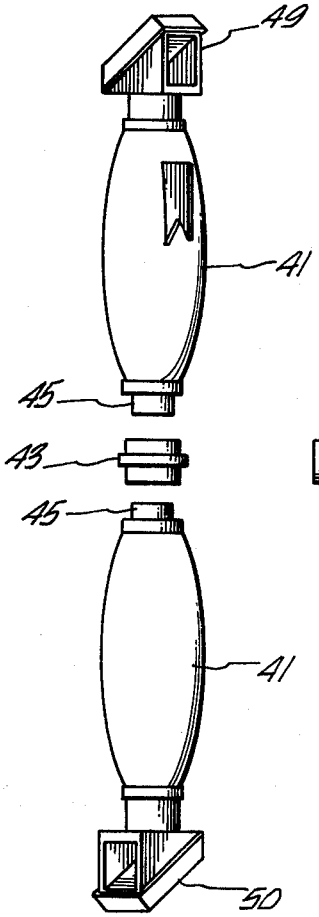
FIG. 3 illustrates a configuration of the elements of FIG. 1 to form a periscope.

As illustrated in FIG. 3, the engine pods 41, the engine hoods 49, 50 and one of the muffler elements 43 may be combined to form a periscope. This assembly is simply configured by press-fitting the engine pod rims 45 into the muffler element which then serves as a connecting nut. The hoods 49, 50 are then press-fitted onto the remaining ends 51 of the pod members 41. The scope of the mirrors 65 in the hoods 49, 50 is arranged at an angle such that a periscope reflection effect is obtained.

Figure 4:
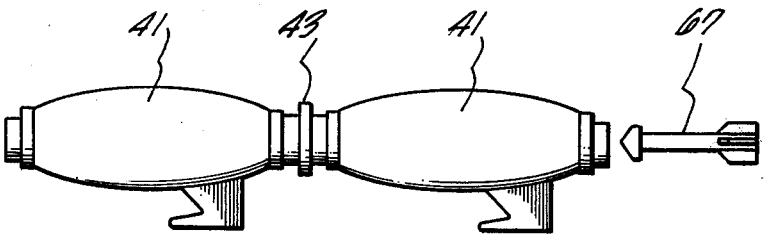
FIG. 4 illustrates a configuration of the elements of FIG. 1 to form a blowgun.
Figure 5:
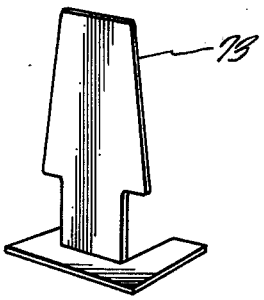
FIG. 5 illustrates a toy target.

By removing the hoods 49, 50 in the configuration of FIG. 3 and appropriately orienting the pod members 41, one may arrive at the configuration of FIG. 4. In this configuration, the two pod members 41 form a blow gun for a small toy rocket 67. The rocket is merely inserted into the rear pod member and appropriate application of breath will propel the toy rocket at a toy target 73 (FIG. 5).

The subject toy is thus reconfigurable and usable as an optical device including a kaleidoscope and a periscope and also as a rocket plane or a blow gun. The kaleidoscope effect produced in the preferred embodiment amounts to a multiplication of and rotation of the image provided by the decal or sticker on the disc 37. Of course, more elaborate image variations could be provided as in traditional kaleidoscopes. The toy admits of many configurations and arrangements of the various press-fit parts disclosed above. Many modifications and adaptations of the above described preferred embodiment will be apparent to one skilled in the art and may be made without departing from the spirit and scope of the invention. Therefore it is to be understood that, within the scope of the appended claims, the invention may be practiced otherwise than as specifically described above.

What is claimed is:

1. A toy comprising:

a rocket body member having an exhaust opening;

nose means for attachment to said body member;

rotatable means configured to represent an antenna at the exterior of said nose means and having a decorative surface visible through the exhaust opening;

first and second engine pod means for removable attachment to the respective sides of said body member, each said pod means having first and second press-fit rims;

reflective means mounted within the body member to translate an image of the decorative surface to the exhaust opening;

first and second hood means containing the optical elements for press-fit attachment to said first and second press-fit rims;

engine muffler means for attachment to said first and second press-fit rims;

a landing gear assembly mounted to the underside of said body member;

horizontal stabilizer assembly mounted to said body; and first and second wing tip means for removable attachment to each of said engine pods respectively, whereby rotation of the rotatable antenna means will provide a rotatable multiple image visible at the exhaust opening.

2. A reconfigurable toy assembly providing when assembled, a configuration simulating a plane having a fuselage and wings, the improvement comprising;

a pair of removable engine members connected to the assembled fuselage and wings, each engine member having an axial bore extending therethrough;

a hollow engine hood member removably connected to each engine member at one end and having an opening at the other end, and a reflective member mounted in each hood member and visible externally of the hood member through at least the open end, whereby the engine members can be removed and linearly connected with a hood member positioned at each end to provide a folded optical path for a periscopic reflection.

3. In a toy assembly configured to simulate an airplane, the improvement comprising;

a fuselage body member having a front nose assembly and rear opening;

reflective means including at least a pair of mirror elements positioned within the fuselage body member to translate an optical path from the front nose assembly through the rear opening, and a rotatable ornamental member movably mounted within the front nose assembly and positioned within the optical path extending from the front nose assembly through the rear opening whereby rotation of the ornamental member provides a rotatable multiple image of the ornamental member at the rear opening resulting from reflection on the pair of mirror elements.

4. The toy of claim 3 further including:

first and second engine pods assemblies press-fit attachable at the sides of said body member.

5. The toy of claim 4 further including engine hood means press-fit attachable on each of said engine pods and containing optical elements capable of forming a periscope.

6. The toy of claim 5 wherein said hood means comprises:

a wedge shaped body member having a front and rear opening and internal ridges having ends defining a slanted planar surface;

a planar mirror element placed on said ridges; and cover means attached to said body member for maintaining said mirror element in place on said ridges.

7. The toy of claim 6 wherein said rear opening is a cylindrical press-fit aperture and said slanted surface is disposed at an acute angle to the axis of said cylinder.

8. The invention of claim 3 wherein the toy assembly further includes;

a pair of removable engine members connected to the fuselage body member, each engine member having an axial bore extending therethrough;

a hollow engine hood member removably connected to each engine member at one end and having an opening at the other end, and a reflective member mounted in each hood member and visible externally of the hood member through at least the open end, whereby the engine members can be removed and linearly connected with a hood member positioned at each end to provide a folded optical path for a periscopic reflection.

9. The invention of claim 8 further including a connector member for interconnecting the engine members.

10. The invention of claim 9 further including a projectile for being fired through the engine members when removed from the body member and interconnected by the connector member.

11. The invention of claim 3 wherein the ornamental member is partially configured to simulate an antenna extending forward of the front nose assembly and manually rotatable by a user to produce the rotatable multiple image.

* * * * *